United States Patent [19]

Tatum et al.

[11] 4,175,021

[45] Nov. 20, 1979

[54] APPARATUS FOR PREVENTING END EFFECT IN ANODES

[75] Inventors: Joe F. Tatum; Thomas H. Lewis, both of Hattiesburg, Miss.

[73] Assignee: C. E. Equipment Co., Inc., Hattiesburg, Miss.

[21] Appl. No.: 884,057

[22] Filed: Mar. 6, 1978

[51] Int. Cl.[2] ..... C23F 13/00

[52] U.S. Cl. ..... 204/196; 204/147; 204/290 F

[58] Field of Search ..... 204/196, 147, 290 F

[56] References Cited

U.S. PATENT DOCUMENTS

| | | | |
|---|---|---|---|
| 1,477,099 | 12/1923 | Baum | 204/290 F |
| 2,855,358 | 10/1958 | Douglas | 204/197 |
| 2,998,359 | 8/1961 | Anderson | 204/38 |
| 3,012,958 | 12/1961 | Vixler | 204/197 |
| 3,354,063 | 11/1967 | Shutt | 204/148 |
| 3,486,996 | 12/1969 | Annand | 204/195 C |
| 3,491,012 | 1/1970 | Winslow | 204/195 C |
| 3,616,354 | 10/1971 | Russell | 204/196 |
| 3,616,418 | 10/1971 | Anderson et al. | 204/196 |
| 3,725,669 | 4/1973 | Tatum | 307/95 |
| 3,929,607 | 12/1975 | Krause | 204/290 |

FOREIGN PATENT DOCUMENTS

| | | | |
|---|---|---|---|
| 866577 | 4/1961 | United Kingdom | 204/196 |

OTHER PUBLICATIONS

"The Use of Platinum Anodes on Land Based Installations".
Platinum Metals Review, Apr. 1958, pp. 45–47.
Platinum Metals Review, Jan. 1960, pp. 15–17.
Corrosion Technology, Feb. 1960, pp. 50 & 51.
Corrosion Technology, Mar. 1960, p. 81.
Corrosion Technology, Jan. 1962, pp. 14–16.
Corrosion Technology, Feb. 1962, pp. 38–40 & 44.
Corrosion Prevention and Control, Oct. 1962, pp. 51, 52 & 54.

*Primary Examiner*—T. Tung
*Attorney, Agent, or Firm*—Dowell & Dowell

[57] ABSTRACT

An apparatus for and method of preventing end effect in deep well impressed current anodes surrounded by a carbonaceous backfill in which the opposite ends of an elongated slender anode are of non-conducting material and the remainder of the anode includes a plurality of alternating segments of conducting and non-conducting material along substantially the entire surface length of the anode. The anode is connected to a source of impressed electrical current and the non-conducting segments cause a substantially constant impressed current density to be transferred from each of the conducting segments along the length of the anode as an electronic discharge and substantially prevents any electrolytic discharge therefrom.

4 Claims, 5 Drawing Figures

APPARATUS FOR PREVENTING END EFFECT IN ANODES

BACKGROUND OF THE INVENTION

1. Field of the Invention

This invention relates generally to impressed current anodes for the cathodic protection of metallic structures and relates particularly to an apparatus and method for causing substantially equal discharge of an impressed electronic current along the entire length of the anode.

2. Description of the Prior Art

In the past, it has been recognized that an underground metallic structure has been subjected to chemical or electrochemical attack which causes rust and other corrosion since the metallic structure normally includes both anodic and cathodic areas. A galvanic electric current normally flows from the ground to the cathodic areas so that substantially no corrosion occurs in these areas; however, an electric current flows from the anodic areas into the ground which promotes corrosion. It is known that a higher electrical current from an impressed current anode system embedded in a carbonaceous backfill environment and located in the area of the underground metallic structure causes the entire surface of the underground metallic structure to become cathodic and thereby substantially prevents corrosion.

Heretofore many efforts have been made to provide anodes and anode systems for the cathodic protection of metallic structures and these have included deep well anode systems, shallow well anode systems, and systems for use in water. Initially sacrificial anodes were provided which emitted a galvanic current and these sacrificial anodes slowly disintegrated so that the useful life of the anode was limited. Some efforts were made to extend the life of the sacrificial anodes by covering portions of the anode surface with a dielectric material. However, care was required to permit sufficient current to flow to prevent corrosion of the structure. Some examples of this type of prior art structure are shown in the U.S. Pat. Nos. to Douglas 2,855,358, Vixler 3,012,958 and Shutt 3,354,063.

In order to extend the effective life of a cathodic protection system and to insure that sufficient current was present at the metallic structure, anodes were provided which were electrically connected to a rectifier or the like so that an impressed electrical current which could be controlled to certain values was applied to the anodes. The anodes were made of iron, high silicon cast iron, steel, copper, graphite, magnetite, and other materials. Normally, in groundbeds, the anodes were embedded in a carbonaceous backfill material such as calcined petroleum coke, metallurgical coke, graphite and the like. An impressed current was applied to the anodes at a current density sufficient to cause the underground metallic structure to become cathodic. However, these anodes slowly deteriorated so that it was necessary to replace them every few years. An example of this type of structure is Tatum U.S. Pat. No. 3,725,669.

In a further effort to extend the life of the anodes, titanium and niobium anodes were provided which were partially or completely plated with a noble metal such as platinum or the like. In the partially plated type of structure, when an impressed current was applied to the anodes, the non-coated portions of the titanium or niobium did not discharge current because the substrate materials had a natural threshold voltage which caused the anode material to polarize and form a non-conducting film along the exposed exterior surfaces, while the current discharge occurred from the platenized surfaces into the carbonaceous backfill material or other electrolyte. This type of anode has been expensive but has had a longer life.

Some examples of this type of structure are the U.S. Pat. Nos. to Baum 1,477,499, Anderson 2,998,359, Krause 3,929,607, British Patent No. 866,577, and the following publications: Platinum Metals Review, Vol. 2, No. 2, April 1958, pages 45–47; Platinum Metals Review, Vol. 4, No. 1, January 1960, pages 15–17; Corrosion Technology, February 1960, page 50; Corrosion Technology, January 1962, pages 14–16; Corrosion Technology, February 1962, pages 38–40; Corrosion Prevention and Control, October 1962, pages 51, 52 & 54.

Generally, these prior art anodes and particularly the anodes used in groundbeds, have been long slender anodes having a length of from 9 inches (23 cm) to 8 feet (244 cm) and a diamter of 1 inch (2.54 cm) to 6 inches (15.24 cm) which included a length-to-diameter ratio in excess of one.

Many of these prior anodes have failed prematurely due to a phenomena known as end effect or penciling and the cause of this phenomena is not clear. The obvious problem caused by end effect is the consumption of the anode material, ordinarily at one or both ends, resulting in a shorter system life. A less obvious problem is the loss of the electrical connection to the anode while the majority of the anode remains intact. This is due to the fact that most of the anodes available have the electrical connection at one end of the anode. Loss of the connection to one anode in a system results in the inability to discharge any current from the affected anode. Assuming a constant current demand, this means that the remaining anodes of the system must contend with a higher current density which compounds the end effect phenomena resulting in a domino effect.

An early attempt to deal with end effect in deep well anodes involved stacking the anodes close together. This technique slowed the rate of attack on most of the anodes in the groundbed; however, end effect on the outer anodes tended to be magnified.

A later attempt involved the addition of extra anode material around the connection at the end of the anode. This technique only delayed the inevitable result.

A more recent attempt to negate the results of end effect involved locating the electrical connection in the center of the anode. This technique did not solve the problem of end effect but it extended the life of the anode since the connection area was the last area of the anode to be consumed due to end effect.

SUMMARY OF THE INVENTION

The present invention is embodied in an apparatus for and method of preventing end effect in a cathodic protection system and particularly in a deep well system having a carbonaceous backfill by causing a substantially constant current density to be discharged from the anode surface along the length thereof and maintaining such discharge at a point where only electronic discharge occurs which causes the carbonaceous backfill to accept substantially all of the electrolytic dissolution and thereby obtain longer anode life. This is done by providing non-conducting material at both ends of the anode and providing a plurality of alternating bands or segments of non-conducting and conducting material along the length of the anode.

It is an object of the invention to provide an anode apparatus for the cathodic protection of underground metallic structures to which an impressed current is applied and the surface of the anode is separated into alternating conducting and non-conducting bands or segments so that the calculated current density is discharged along the length of the anode and remains as an electronic discharge instead of an electrolytic discharge.

Another object of the invention is to provide a method of preparing a deep well cathodic protection system including at least one anode located in a carbonaceous backfill to which an impressed current is applied, including the steps of preparing the anodes of the system in a manner such that the current density is discharged substantially equal from the surface along the length of the anodes so that the impressed current which is transferred to the backfill remains as an electronic discharge.

DESCRIPTION OF THE PREFERRED EMBODIMENTS

Figure 1:
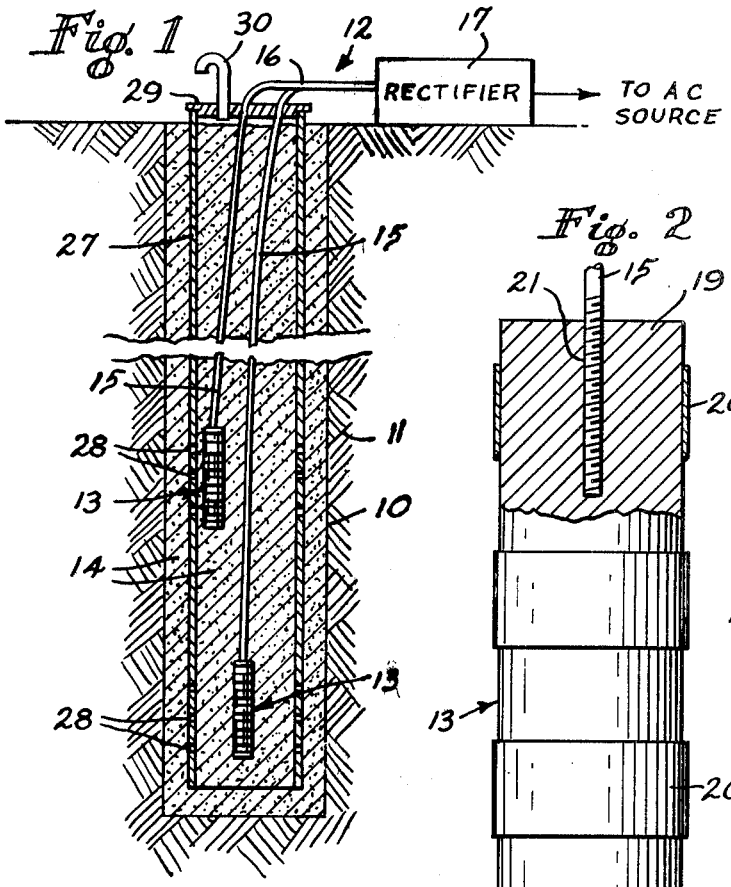
FIG. 1 is a diagramatic vertical section of a deep well cathodic protection system for underground metallic structures.

Although the end effect phenomena has been recognized, the cause has not been adequately explained. The following hypothesis is offered as a possible explanation:

End effect appears to be an increased discharge current density occurring at the ends of an impressed current anode which results in a proportional increase in the consumption rate of the anode material and which causes a penciling effect at one or both ends of the anode in a cathodic protection system. We have determined that if an inert anode is placed in a groundbed of carbonaceous material and a current discharge from the surface of the anode is maintained below approximately 1500 milliamps per square foot, the current transferred from the anode surface will be an electronic discharge and substantially no deterioration of the anode occurs. However, when a long slender anode is placed in the carbonaceous material and the entire surface is calculated to maintain the current density below 1500 milliamps per square foot, the current density at the ends of the anode frequently rises above that which is a threshold for electrolytic discharge and the anode deteriorates on the ends.

Consider a cylindrical anode surrounded by a homogeneous soil electrolyte. Visualize this anode as being made up of a multiplicity of thin cross-sectional slices or segments in which each segment is exposed to the same electrical discharge path to remote earth, i.e., a cross-section of earth with an increasingly larger radius in the same plane as the segment. Now consider the two end segments which are not only exposed to the same path as the other segments, but also a path consisting of a hemisphere of earth with an ever increasing radius. Since these end segments are exposed to a much greater volume of earth in which to discharge current, a larger discharge current density can occur in this area before current crowding becomes significant. In other words, each segment of the anode mutually interferes with every other segment but the effect is much less on the ends.

The fact that the greater amount of current is discharged from the ends of the anodes was confirmed in a first test by plotting an equipotential curve around an anode having a fixed discharge current. The test used to plot the equipotential curve included a steel rod anode having a length of 30 inches (76 cm) and a diameter of one inch (2.5 cm) and discharging an impressed current of 17.1 milliamps to a remote cathode. The equipotential curve showed that the curve is much closer to the ends of the anode than the center. This indicates that approximately two-thirds of the current was being discharged from the ends of the anode.

Another test was conducted to confirm the higher current discharge from the anode ends. In this second test, a carbon steel rod anode having a length of 9 inches (23 cm) and a diameter of 0.375 inch (9.53 mm) was immersed in a water electrolyte treated with sodium chloride to lower its resistivity and a current discharge of one ampere was maintained for 66 hours. The anode lost approximately one-half inch (13 mm) in length. This fact coupled with the obvious penciling of the ends of the rod, indicated the existence of end effect. By calculating the current discharge for each half inch (13 mm) segment of the anode using material loss techniques, the current density at the ends of the anode indicated approximately 2.5 times greater discharge current density than the center. The results of this test are tabulated in the following table:

| Segment Number | Segment Diameter (in.) | Volume Metal Remaining ($in.^3$) | Volume Metal Consumed ($in.^3$) | Weight Loss (oz.) | Amps Discharged | Current Density ($A/ft.^2$) |
|---|---|---|---|---|---|---|
| 1 | (¼-.2) | (.0079) | (.047) | (.212) | .088 | (34.0) |
| 2 | (.225) | (.020) | (.035) | (.158) | .065 | (20.0) |
| 3 | (.260) | (.027) | (.028) | (.126) | .052 | (15.0) |
| 4 | (.275) | (.030) | (.025) | (.113) | .047 | (13.3) |
| 5 | (.275) | (.030) | (.025) | (.113) | .047 | (13.3) |
| 6 | (.275) | (.030) | (.025) | (.113) | .047 | (13.3) |
| 7 | (.275) | (.030) | (.025) | (.113) | .047 | (13.3) |
| 8 | (.275) | (.030) | (.025) | (.133) | .047 | (13.3) |
| 9 | (.275) | (.030) | (.025) | (.113) | .047 | (13.3) |
| 10 | (.260) | (.027) | (.028) | (.126) | .052 | (15.0) |
| 11 | (.275) | (.030) | (.025) | (.133) | .047 | (13.3) |
| 12 | (.275) | (.030) | (.025) | (.133) | .047 | (13.3) |
| 13 | (.275) | (.030) | (.025) | (.113) | .047 | (13.3) |

-continued

| Segment Number | Segment Diameter (in.) | Volume Metal Remaining (in.$^3$) | Volume Metal Consumed (in.$^3$) | Weight Loss (oz.) | Amps Dis-charged | Current Density (A/ft.$^2$) |
|---|---|---|---|---|---|---|
| 14 | (.275) | (.030) | (.025) | (.113) | .047 | (13.3) |
| 15 | (.250) | (.025) | (.030) | (.135) | .056 | (16.4) |
| 16 | (.240) | (.023) | (.032) | (.144) | .060 | (17.9) |
| 17 | (.250) | (.025) | (.030) | (.135) | .056 | (16.4) |
| 18 | (¼-.2) | (.0079) | (.047) | (.212) | .088 | (34.0) |

Theoretically it is possible to distribute the current density substantially evenly over the length of the anode by segmenting the anode, placing a compact carbonaceous backfill in intimate engagement with the entire surface of the anode and adjusting the discharge current density to a value such that all current discharge will be electronically conducted through the backfill. This should solve the end effect problem and provide an infinite anode life as long as the carbonaceous backfill remains intact.

It is further reasoned that if end effect is due to the geometry of the anode discharge surface, then the key to solving the problem resides in determining the most effective geometry of the anode surface. If the anode could be divided into small segments which are electrically connected together but physically separated from each other, then a more uniform discharge current density could be obtained.

In order to determine the most effective geometry of the anodes, four different anodes were tested with each anode being approximately 9 inches (23 cm) in length and 0.375 inch (9.53 mm) in diameter. These anodes had the following configuration:

1. Bare anode,
2. Six ¾ inch (2 cm) bare segments separated by ¾ inch (2 cm) segments of non-conducting material,
3. Four one-inch (2.5 cm) bare segments separated by one inch (2.5 cm) segments of non-conducting material,
4. Two two-inch (5 cm) bare segments separated by 1½ inch (3.8 cm) segments of non-conducting material.

These anodes were weighed and placed in individual steel tubs containing tap water treated with sodium chloride to lower resistivity. An impressed current was applied to each anode and was adjusted to 147 milliamps and maintained by a periodic checking and adjustment when necessary. After 236 hours the anodes were removed, cleaned, weighed and inspected. It was noted that the evidence of end effect became less pronounced as the segment size decreased.

Another interesting fact was uncovered when it was discovered that the resistance to earth of a segmented anode varies depending on the configuration of the segments even though the exposed surface area is held constant. One steel rod anode measuring 9 inches (23 cm) in length and 0.375 inch (9.53 mm) in diameter was partially covered with non-conducting material in four different configurations, placed in a steel tub containing tap water treated with sodium chloride and tested to determine the resistance between the anode and the tub. The configurations tested were as follows:

1. Six ¾ inch (2 cm) bare segments and six ¾ inch (2 cm) covered segments,
2. Three 1½ inch (4 cm) bare segments and three 1½ inch (4 cm) covered segments,
3. Two 2¼ inch (6 cm) bare segments and two 2¼ inch (6 cm) covered segments,
4. One 4½ inch (11 cm) bare segment and one 4½ inch (11 cm) covered segment.

Each of the covered configurations exposed a surface area which is one-half of the total anode surface area. The resistance measured indicated that the smallest segments showed the least resistance, while the largest segments showed the greatest resistance. In this test the first anode showed an increase in resistance of approximately 24% as compared to a bare anode, while the last anode showed an increase in resistance of approximately 70%.

Accordingly, it was concluded that

1. End effect is due to the mutual interference of adjacent anode segments and therefore is a function of the geometry of the anode,
2. The results of end effect can be controlled by controlling the discharge current density,
3. The discharge current density can be made uniform by proper segmentation of the anode,
4. The resistance to earth of a segmented anode is a function of the segment configuration,
5. Uniform current density, a compact carbonaceous backfill, and a current density discharge below that causing electrolytic current transfer appear to be the solutions to the problem of premature failure of the anode caused by end effect.

With continued reference to the drawing, a bore hole 10 is drilled into the earth 11 to a desired depth so that a cathodic protection system 12 may be provided to prevent rust and other corrosion in an underground metallic structure (not shown). The cathodic protection system includes one or more anodes 13 embedded in a carbonaceous backfill material 14 which may include calcined petroleum coke, metallurgical coke, graphite and the like. Each anode is connected by a lead wire 15 to a main electric wire 16 which is connected to a rectifier 17 at the surface and such rectifier may be adjusted to supply a predetermined impressed current to the anodes in order that a selected current density is transferred from the surface of the anodes to the carbonaceous backfill material and such carbonaceous material discharges the current to the earth so that such current flows to any underground metallic structure in the area and causes such structure to be cathodic over its entire surface.

Each of the anodes of the system normally is from 9 inches (23 cm) to 8 feet (244 cm) in length and has a diameter of 1 inch (2.54 cm) to 6 inches (15.24 cm). The length-to-diameter ratio of each anode normally is substantially greater than five to one. In order to cause the current density from each of the anodes to be distributed along the length of the cylindrical surface, the opposite ends of each of the anodes includes a non-conducting material and the intermediate portion of the anode has a plurality of equally spaced bands or segments of conducting and non-conducting material. Such segments extend around the anode generally normal to the longitudinal axis thereof in a manner such that the conducting segments are not connected to each other at the surface of the anode. It is preferred that the non-conducting bands or segments which are spaced along the length of the anode be relatively small in length such as one inch (2.5 cm) or less and that the conducting segments located between such non-conducting segments are of similar length and have a length-to-diameter ratio of three to one or less. Also it is preferred that the total area of the conducting segments be substantially the same as the total area of the non-conducting segments.

Figure 2:
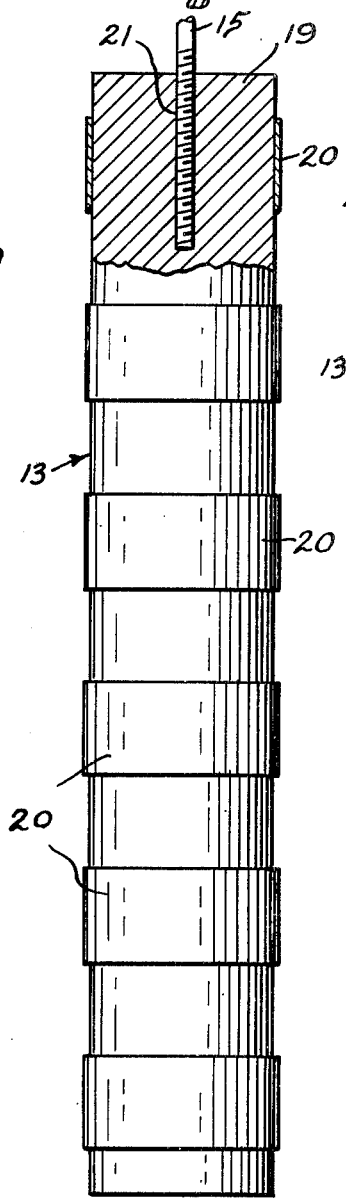
FIG. 2 is a side elevation of one embodiment of an anode with portions broken away for clarity.

With particular reference to FIG. 2, the anode 13 includes a body 19 which is constructed of titanium, niobium (columbium), or the like, which rapidly polarizes to form a non-conducting film on the exposed surface when an impressed current is applied. The body has a plurality of spaced bands or segments 20 of platinum, gold, silver, or other noble metal, which may be placed thereon in any desired manner, as by electrodeposition or the like. It is noted that the conducting segments 20 are spaced inwardly from the ends a distance equal to substantially one-half the distance between the conducting segments located along the length of the anode. In this embodiment the lead wire 15 is attached in any desired manner. It is illustrated as being threadedly attached to a threaded recess 21 in one end of the anode body.

Figure 3:
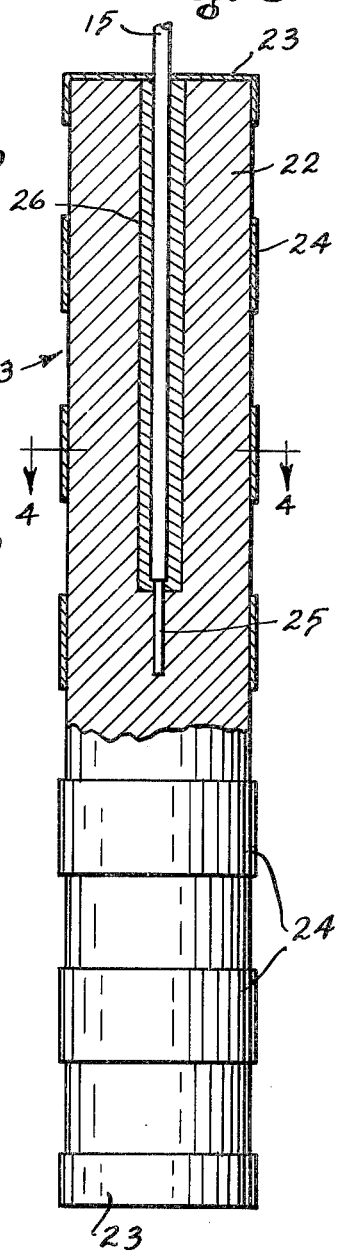
FIG. 3 is a side elevation of another embodiment of an anode with portions broken away for clarity.
Figure 4:
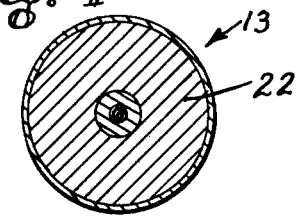
FIG. 4 is a section taken on the line 4—4 of FIG. 3.
Figure 5:
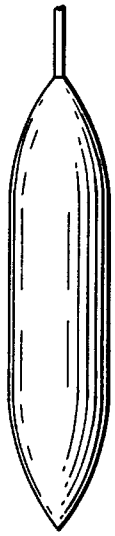
Fig. 5 PRIOR ART
FIG. 5 is a side elevation of a prior art anode illustrating the end effect phenomena.

With particular reference to FIG. 3, the anode 13 includes a body 22 which is constructed of iron, steel, graphite, magnetite, copper, or the like which does not form a polarized film when a current is applied thereto. A cap 23 of dielectric material is fixed to each end of the body and a plurality of non-conducting segments 24 are equally spaced along the length of such body. The non-conducting segments may be formed of dielectric tape or other material which may be applied manually or automatically in any desired areas.

In this embodiment the body includes an axial bore 25 extending from one end of the body to a position generally centrally thereof, and a counterbore 26 extending inwardly from the end of the body. The bare end of the lead wire 15 may be threadedly received within the bore 25 or may be force-fitted in intimate engagement therewith. After the end of the lead wire is in position within the bore, the counterbore is filled with a waterproof packing of dielectric material to insulate the lead wire and prevent water or other liquid from entering the anode.

It may be desirable to remove the anodes from the bore hole periodically for inspection purposes and to facilitate such removal a casing 27 of dielectric thermoplastic material may be placed within the bore hole to protect the anodes and the lead wire from cave-ins of the bore holes. Since different strata of the earth have differing resistivity to the passage of electrical current, the anodes 13 may be located at one or more selected elevations within the casing. Such casing has at least one opening or window 28 located adjacent to each of the anodes to permit the impressed current to flow through the carbonaceous backfill material into the soil.

When the casing 27 is to be used, the carbonaceous backfill material is located both interiorly and exteriorly thereof. In order to prevent foreign material from entering the casing 27, a cover 29 is mounted on the top of the casing and such cover preferably includes a vent tube 30 to discharge any gases generated within the casing 27. When it is desired to remove the anodes for inspection, the cover 29 is removed and a liquid such as water or the like is introduced into the casing to fluidize the carbonaceous backfill material therein. After the backfill material has been fluidized, the anodes may be removed by pulling on the main wire 15 which lifts the anodes from within the casing. After the anodes have been inspected and any defective anode replaced, the backfill material within the casing is again fluidized and the anodes are placed within the casing so that such anodes sink by gravity into the backfill material.

We claim:

1. Apparatus for preventing end effect in anodes used in an impressed current deep well cathodic protection system for metallic structure in which the apparatus intimately engages a carbonaceous backfill, comprising an anode having an elongated body of current conducting material located along a longitudinal axis, a plurality of current conducting and non-conducting segment alternately disposed along the length of the surface of said body and generally normal to the longitudinal axis thereof, each end of said body terminating in a non-conducting segment, said conducting segments being equally spaced along said body and being separated by said non-conducting segments, said conducting segments being substantially the same length as said non-conducting segments other than the non-conducting segments at the ends of said body, the length of each conducting segment being no more than three times the diameter thereof, means for connecting said body to a source of impressed electrical current so that a uniform electronic current is discharged from each of said conducting segments, and said connecting means supporting said anode within the carbonaceous backfill.

2. The structure of claim 1 in which said body is constructed of electrical energy conducting material which forms said conducting segments, and said non-conducting segments are constructed of dielectric material.

3. The structure of claim 1 in which said body is constructed of a material selected from titanium, niobium, and the like in which the surface polarizes when an impressed current is applied to form an electrical insulating film, and said conducting segments are constructed of noble metal.

4. The structure of claim 3 in which said noble metal is platinum.

* * * * *